US006644034B2

(12) United States Patent
Ariyoshi et al.

(10) Patent No.: US 6,644,034 B2
(45) Date of Patent: Nov. 11, 2003

(54) LINER SUPPORTING STRUCTURE FOR ANNULAR COMBUSTER

(75) Inventors: Kazuo Ariyoshi, Kobe (JP); Yoshihiro Matsuda, Kobe (JP); Hiroaki Miyamoto, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/052,253

(22) Filed: Jan. 23, 2002

(65) Prior Publication Data

US 2002/0108378 A1 Aug. 15, 2002

(30) Foreign Application Priority Data

Jan. 25, 2001 (JP) ..... 2001-017039

(51) Int. Cl.[7] ..... F02C 7/20
(52) U.S. Cl. ..... 60/800; 60/753
(58) Field of Search ..... 60/800, 753, 752, 60/799

(56) References Cited

U.S. PATENT DOCUMENTS 4,907,743 A * 3/1990 Bouiller et al. ..... 239/265.11
5,237,820 A * 8/1993 Kastl et al. ..... 60/752
5,524,430 A * 6/1996 Mazeaud et al. ..... 60/798
6,134,877 A * 10/2000 Alkabie ..... 60/800
6,240,731 B1 * 6/2001 Hoke et al. ..... 60/732
6,397,603 B1 * 6/2002 Edmondson et al. ..... 60/753
6,497,105 B1 * 12/2002 Stastny ..... 60/796

FOREIGN PATENT DOCUMENTS

JP 2647144 5/1997

* cited by examiner

*Primary Examiner*—Ehud Gartenberg
(74) *Attorney, Agent, or Firm*—Oliff & Berridge, PLC

(57) ABSTRACT

The liner supporting structure for the annular combustor of the present invention has a flexible connection member of connecting a structural body constituting a part of the combustor to a liner, the connection member having a first end positioned on a side of the structural body and a second end positioned on a side of the liner, the second end being disposed on an outer surface of an end part of the liner positioned on the side of the structural body; a first fixing means of fixing the first end of the connection member to the structural body; and a second fixing means of fixing the second end of the connection member to the end part of the liner. According to the present invention, even in the case that there is a large difference in linear expansion coefficient between the materials of the liner and the structural body of the combustor for supporting the liner so that a relative displacement is generated between the two due to temperature changes, the structural body of the combustor can strongly support the liner without applying excessive stress to the liner formed by, for example, a ceramics material.

18 Claims, 4 Drawing Sheets

PRIOR ART

LINER SUPPORTING STRUCTURE FOR ANNULAR COMBUSTER

BACKGROUND OF THE INVENTION

1. Field of the Invention

The present invention relates to a liner supporting structure for annular combustor and more particularly to a liner supporting structure suitable for an annular combustor in which a liner and a structural body of a combustor supporting the liner are composed of materials extremely different from each other in linear expansion coefficient.

2. Description of the Related Art

In recent years, as a material of a liner constituting a gas turbine combustor, in place of conventional metallic materials, ceramics materials such as CMC (ceramics matrics composite) excellent in heat resistance have been used. By use of them, cooling air for cooling the liner can be greatly reduced, and the thermal efficiency can be improved, and surplus air can be used for lean combustion, and the discharge amount of nitrogen oxide can be reduced.

Generally, ceramics materials have a smaller linear expansion coefficient than that of metallic materials. Therefore, in an annular combustor, when a liner composed of a ceramics material is to be mounted on a dome composed of a metallic material as conventional, due to a difference in thermal expansion value between the dome and the liner during combustion, a relative displacement is caused between the dome and the liner at the connection between them. Therefore, when the liner is to be composed of a ceramics material, some measure must be taken so as to eliminate the unfavorable effect due to the difference in linear expansion coefficient.

As a measure for eliminating such an unfavorable effect due to a difference in linear expansion coefficient, for example, application of the liner supporting structure of a gas turbine combustor proposed in Japanese Patent No. 2647144 may be considered.

Namely, as shown in FIG. 5, it is a method for holding the plate spring 104 shown in FIG. 6 in the fitting part 103 between the dome (inner cylinder) 101 and the liner (tail cylinder) 102 of the gas turbine combustor 100 and supporting the liner 102 by the dome 101 using the elastic force of the plate spring 104.

However, ceramics materials are generally brittle and have no ductility and strength like metallic materials, so that in the aforementioned support method for acting comparatively large pressing force between the liner 102 and the dome 101, there is a risk that fretting may be generated in the liner 102, or the liner 102 may be destroyed. Further, the plate spring generally has a short stroke of effective elastic deformation, so that there is the possibility that it cannot correspond to a large dimensional difference. Furthermore, even though the support method may perform the support in the radial direction of the dome 101 and the liner 102, it cannot sufficiently cope with external force acting in the circumferential direction and axial direction.

SUMMARY OF THE INVENTION

The present invention was developed with such a foregoing problem of the related art in view and is intended to provide a liner supporting structure for an annular combustor for, even when there is a large difference in linear expansion coefficient between the respective materials of a liner and a structural body of the combustor for supporting the liner, eliminating an unfavorable effect due to the difference in linear expansion coefficient and supporting the liner by the structural body of the combustor in a state that each member constituting the combustor is free of damage, and an annular combustor having such a liner supporting structure.

According to the present invention, a liner supporting structure for an annular combustor of which a liner for forming a combustion chamber is connected to a structural body constituting a part of said combustor so that said liner is supported by said structural body, comprises: a flexible connection member of connecting said structural body to said liner, said connection member having a first end positioned on a side of said structural body and a second end positioned on a side of said liner, said second end being disposed on an outer surface of an end part of said liner positioned on said side of said structural body; first fixing means of fixing said first end of said connection member to said structural body; and second fixing means of fixing said second end of said connection member to said end part of said liner.

According to the present invention, an annular combustor comprises: a liner for forming a combustion chamber; a structural body connected to said liner; and a liner supporting structure for connecting said liner to said structural body so that said liner is supported by said structural body, said liner supporting structure including: a flexible connection member of connecting said structural body to said liner, said connection member having a first end positioned on a side of said structural body and a second end positioned on a side of said liner, said second end being disposed on an outer surface of an end part of said liner positioned on said side of structural body; first fixing means of fixing said first end of said connection member to said structural body; and second fixing means of fixing said second end of said connection member to said end part of said liner.

Preferably, said connection member is a flat member.

Preferably, a spacer is disposed between said second end of said connection member and said outer surface of said end part of said liner.

Preferably, a seal ring is slidably mounted on a part of said structural body corresponding to a position between said first end and said second end, an end edge of said liner on said side of said structural body being in contact with said seal ring.

Preferably, said seal ring is disposed at a stepped part formed on said part of said structural body corresponding to said position between said first end and said second end.

Preferably, said seal ring has a surface perpendicular to a central axis of said annular combustor, said end edge of said liner being in contact with said surface perpendicular to said central axis.

Preferably, said seal ring is pressed against said end edge of said liner by an elastic member.

Preferably, said structural body is a dome of said annular combustor.

Preferably, said liner is made of a ceramics material.

According to the present invention constituted as mentioned above, even if there is a large difference in linear expansion coefficient between the materials of the liner and the structural body of the combustor for supporting the liner, and a relative displacement is generated between the two due to temperature changes, the structural body of the combustor can strongly support the liner without applying excessive stress to the liner formed by, e.g., a ceramics material.

BRIEF DESCRIPTION OF THE DRAWINGS

The aforementioned object, another object, characteristics, and advantages of the present invention will become more apparent from the following explanation referring to the accompanying drawings.

DESCRIPTION OF THE PREFERRED EMBODIMENTS

A liner supporting structure for an annular combustor of an embodiment of the present invention will be explained hereunder by referring to the accompanying drawings.

Figure 1:
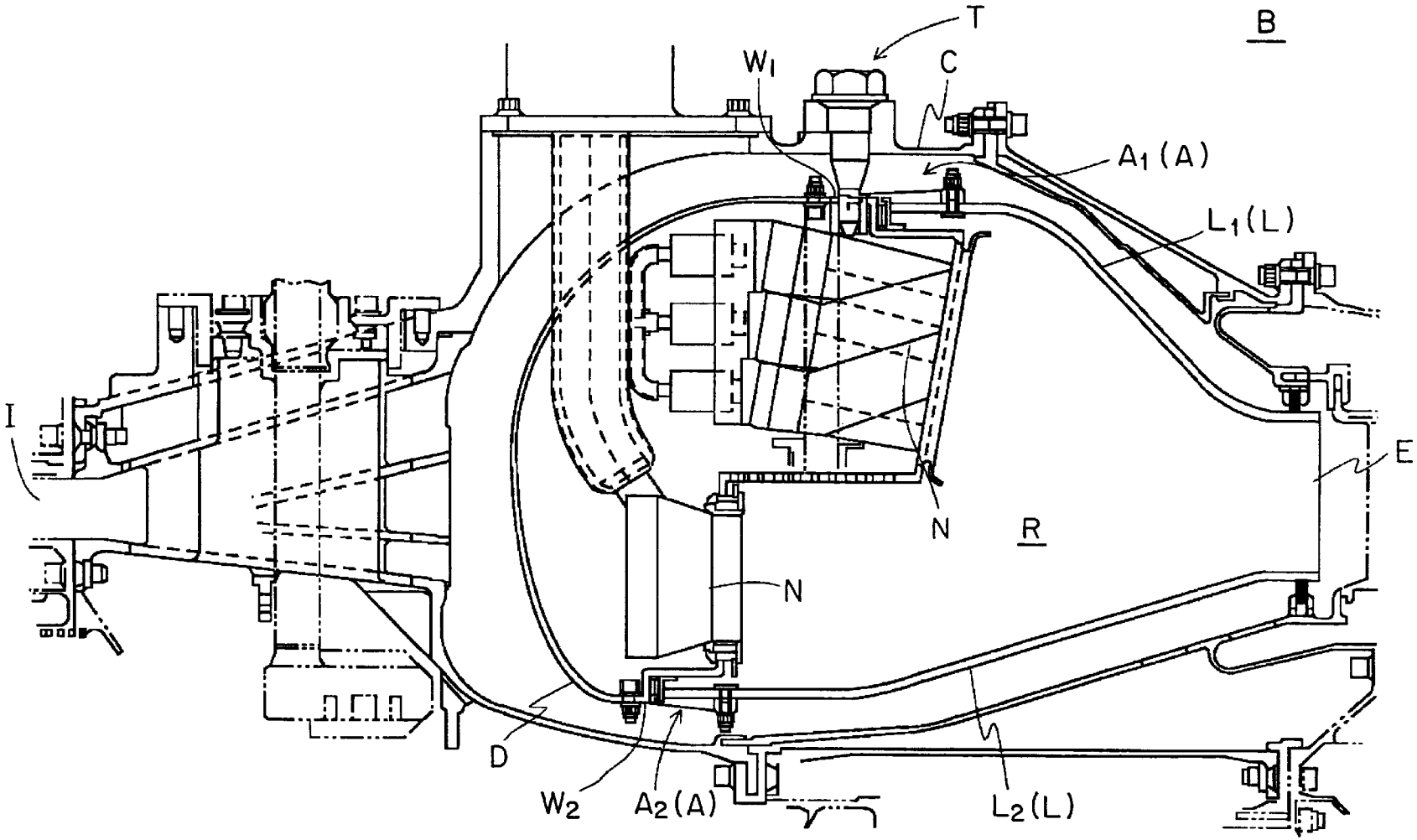
FIG. 1 is a drawing showing the schematic constitution of a gas turbine having an annular combustor including a liner supporting structure as an embodiment of the present invention.

As shown in FIG. 1, the liner supporting structure A of the annular combustor of this embodiment is a structure for supporting the liner L forming the combustion region (combustion chamber) R of the annular combustor B of the gas turbine T by the dome D.

In the gas turbine T having the annular combustor B, the combustor B is installed in the case C and has a doughnut shape having the outlet E opened on one side thereof. The combustion chamber R of the combustor B is formed between the two cylindrical liners $L_1$ and $L_2$ having different diameters. The ends of the liners $L_1$ and $L_2$ constituting the liner L on the side of the combustor inlet I are connected to the outer peripheral wall $W_1$ and inner peripheral wall $W_2$ of the dome D, which has a half doughnut shape and is a structural body constituting a part of the combustor B, almost face to face.

The dome D is made of, for example, a cobalt base heat resistant alloy and internally has a plurality of built-in fuel nozzles N.

On the other hand, the liners $L_1$ and $L_2$ are made of a ceramics material such as CMC (ceramics matrics composite).

As mentioned above, the dome D and the liner L ($L_1$ and $L_2$) are made of materials largely different in linear expansion coefficient from each other.

Figure 2:
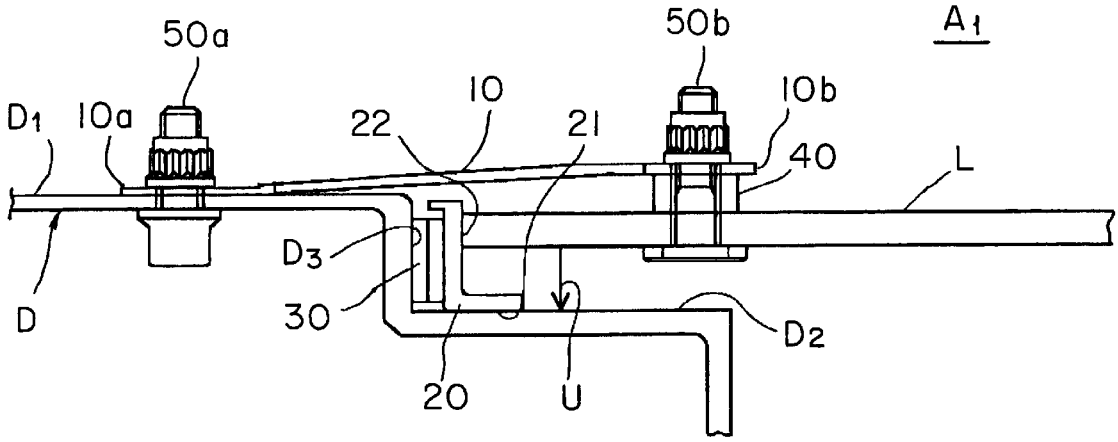
FIG. 2 is a drawing showing the detailed liner supporting structure of the gas turbine shown in FIG. 1.

FIG. 2 shows the liner supporting structure $A_1$ installed on the side of the outer peripheral wall $W_1$ of the combustor B shown in FIG. 1. The liner supporting structure $A_2$ installed on the side of the inner peripheral wall $W_2$ of the combustor B also has the same structure as the liner supporting structure $A_1$ shown in FIG. 2. Further, a plurality of such liner supporting structures ($A_1$ and $A_2$) are installed in the circumferential direction of the combustor B at constant intervals.

As shown in FIG. 2, the liner supporting structure $A_1$ has a flexible support plate (connection member) 10 fixed between the surface of the large diameter portion $D_1$ of the dome D and the surface of the liner L so as to extend between the dome D and the liner L. A first end 10*a* of the support plate 10 is fixed to the dome D by a first clamp (first fixing means) 50*a* and a second end 10*b* of the support plate 10 is fixed to the end of the liner L on the side of the dome D by a second clamp (second fixing means) 50*b*. To keep the air tightness of the connection between the dome D and the liner L, a seal ring 20 is installed. To press the seal ring 20 on the end edge of the liner L, a wave ring 30 is installed between the dome D and the seal ring 20. For the second clamp 50*b*, a spacer 40 is installed between the second end 10*b* of the support plate 10 and the surface of the liner L, thus the support plate 10 is spaced from the surface of the liner L by a predetermined distance.

Figure 3:
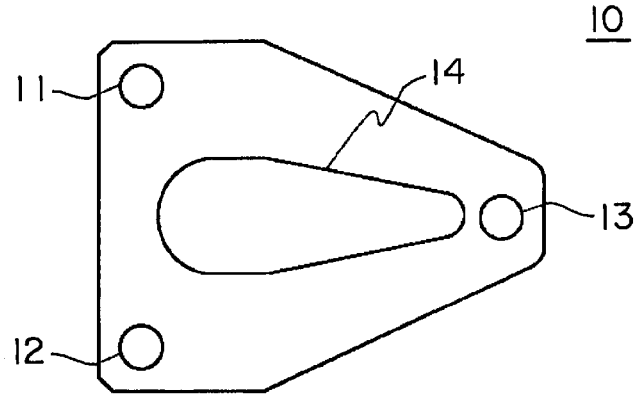
FIG. 3 is a drawing showing the schematic constitution of a support plate of the liner supporting structure.

As shown in FIG. 3, the support plate 10 is made of, for example, a material having desired elasticity such as a nickel base heat resistant alloy. Further, the support plate 10 has an isosceles triangle shape that the apex thereof is cut off and both sides are cut off in a predetermined width. The support plate 10 are fixed to the surface of the large diameter portion $D_1$ of the dome D by the first clamp 50*a* composed of, for example, a bolt and a nut via holes 11 and 12 formed at two points equivalent to the base angles of the isosceles triangle and fixed to the surface of the liner L by the second clamp 50*b* composed of, for example, a bolt and a nut via a hole 13 formed at one point equivalent to the vertical angle. Further, at the middle part of the support plate 10 inside from the holes 11, 12, and 13, to improve light weight and flexibility, a through hole (transmission hole) 14 in a predetermined shape is formed. The shape of the through hole 14, in the example shown in the drawing, is a triangular shape with the bottom rounded. However, the shape of the through hole 14 is not limited to the example shown in the drawing, and various shapes can be used, for example, a punching metal shape can be used.

The seal ring 20 is composed of a ring member having an L-shaped section and arranged concentrically with the central axis of the annular combustor B. An inner surface 21 (surface parallel with the central axis of the annular combustor B) of one side of the L shape of the seal ring 20 is in contact with the surface (surface parallel with the central axis of the annular combustor B) of the small diameter portion $D_2$ of the dome D, that is, in contact with the stepped surface projected on the side of the combustion chamber R of the dome D and an inner surface 22 of the other side (surface perpendicular to the central axis of the annular combustor B) is in contact with the end edge of the liner L. When the liner L displaces relative to the dome D due to temperature changes, the liner L slides in a state that the end edge thereof is in contact with the inner surface 22 of the seal ring 20. By doing this, the air tightness of the connection between the dome D and the liner L is maintained.

Figure 4:
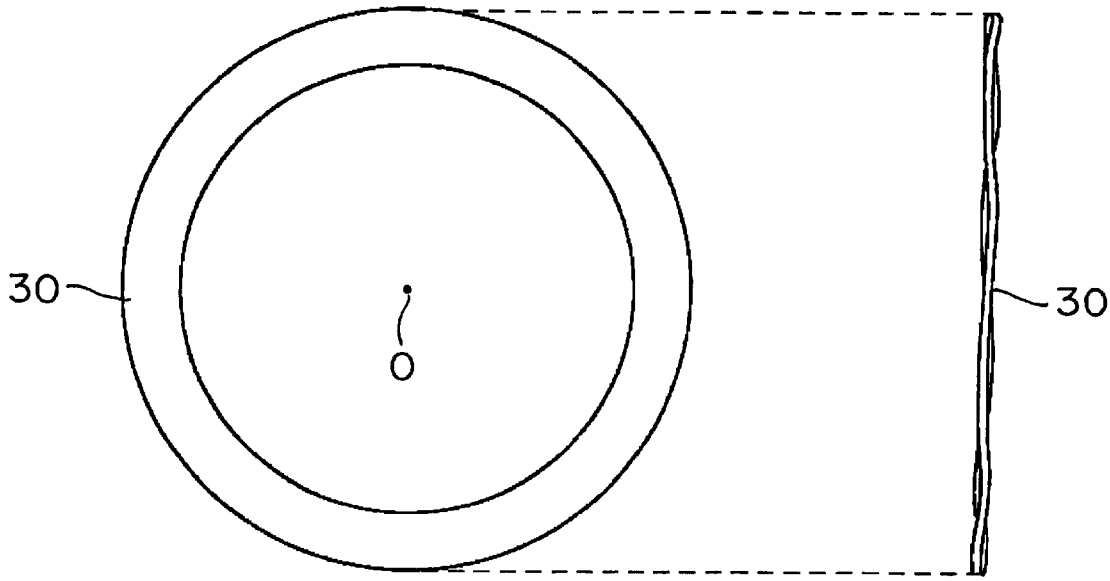
FIG. 4 is a drawing showing the schematic constitution of a wave ring of the liner supporting structure.
Figure 5:
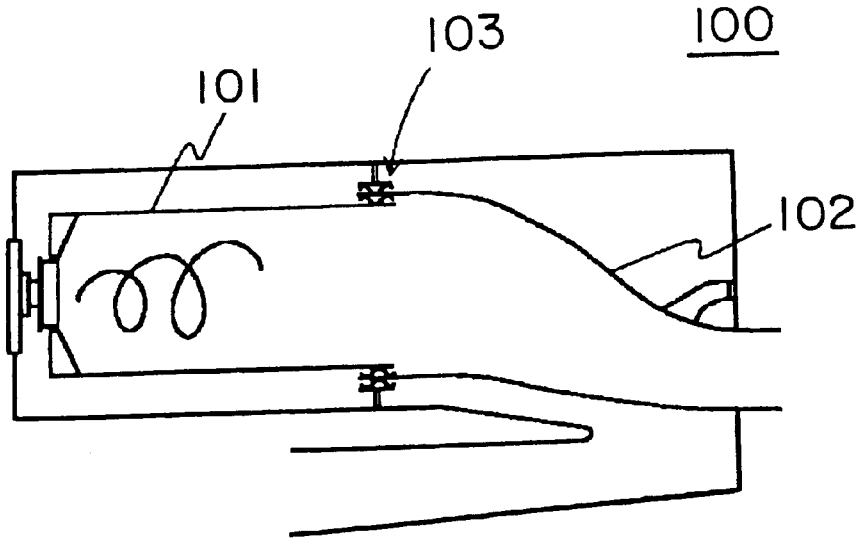
FIG. 5 PRIOR ART
FIG. 5 is a drawing showing the schematic constitution of a gas turbine having a conventional liner supporting structure.
Figure 6:
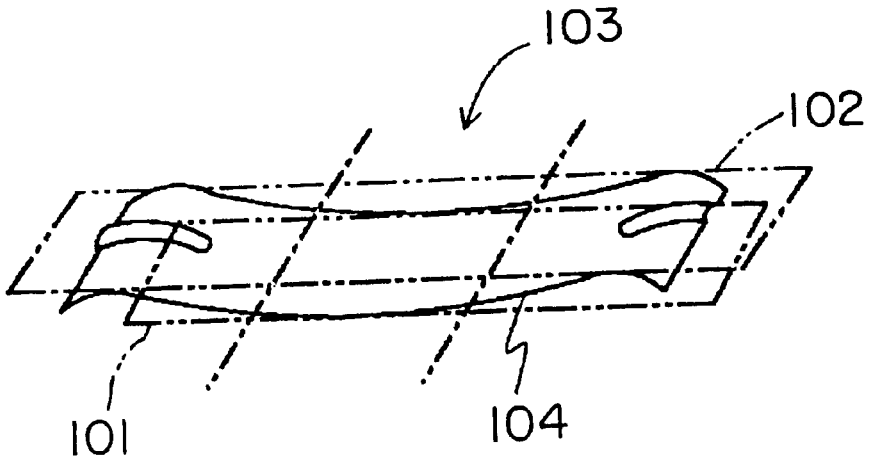
FIG. 6 is a drawing showing a plate spring of the conventional liner supporting structure of the gas turbine shown in FIG. 5.

As shown in FIG. 4, the wave ring 30 is composed of a ring corrugated member and arranged concentrically with the central axis O of the annular combustor B in the same way as with the seal ring 20. The wave ring 30 is installed between the stepped portion $D_3$ (surface perpendicular to the central axis O of the annular combustor B) between the large diameter portion $D_1$ and the small diameter portion $D_2$ of the dome D and the seal ring 20, and the seal ring 20 is pressed against the end edge of the liner L.

The spacer 40 is, for example, a ring member to be fitted to the bolt of the second clamp 50*b* for fixing the support plate 10 to the surface of the liner L. By the spacer 40, for example, even when the dome D is expanded during combustion and the liner L relatively displaces to the dome D in the direction of the arrow U shown in FIG. 2, the support plate 10 can support the liner L free of interference with the dome D.

The liner supporting structure A ($A_1$ and $A_2$) having such a constitution almost restricts the relative displacement in the circumferential direction and axial direction of the dome D and liner L, and gives a certain degree of freedom to the relative displacement in the radial direction, thereby supports the liner L by the dome D. Therefore, even when a comparatively large relative displacement is generated at the connection of the liner L and dome D due to a difference in the linear expansion coefficient of each member, the liner L can be supported on the dome D free of reduction in the air tightness of the connection and free of an excessive load on the liner L.

The present invention is explained above on the basis of an embodiment. However, the present invention is not limited only to such an embodiment and may be variously modified. In the aforementioned embodiment, an example of the gas turbine combustor is explained. However, application of the present invention is not limited to the gas turbine combustor and the present invention can be applied to various annular combustors.

What is claimed is:

1. A liner supporting structure for an annular combustor of which a liner for forming a combustion chamber is connected to a structural body constituting a part of said combustor so that said liner is supported by said structural body, comprising:

a flexible connection member of connecting said structural body to said liner, said connection member having a first end positioned on a side of said structural body and a second end positioned on a side of said liner, said second end being disposed on an outer surface of an end part of said liner positioned on said side of said structural body;

first fixing means of fixing said first end of said connection member to said structural body; and second fixing means of fixing said second end of said connection member to said end part of said liner.

2. A liner supporting structure according to claim 1, wherein said connection member is a flat member.

3. A liner supporting structure according to claim 1, wherein a spacer is disposed between said second end of said connection member and said outer surface of said end part of said liner.

4. A liner supporting structure according to claim 1, wherein a seal ring is slidably mounted on a part of said structural body corresponding to a position between said first end and said second end, an end edge of said liner on said side of said structural body being in contact with said seal ring.

5. A liner supporting structure according to claim 4, wherein said seal ring is disposed at a stepped part formed on said part of said structural body corresponding to said position between said first end and said second end.

6. A liner supporting structure according to claim 4, wherein said seal ring has a surface perpendicular to a central axis of said annular combustor, said end edge of said liner being in contact with said surface perpendicular to said central axis.

7. A liner supporting structure according to claim 4, wherein said seal ring is pressed against said end edge of said liner by an elastic member.

8. A liner supporting structure according to claim 1, wherein said structural body is a dome of said annular combustor.

9. A liner supporting structure according to claim 1, wherein said liner is made of a ceramics material.

10. An annular combustor comprising:

a liner for forming a combustion chamber;

a structural body connected to said liner; and a liner supporting structure for connecting said liner to said structural body so that said liner is supported by said structural body, said liner supporting structure including:

a flexible connection member of connecting said structural body to said liner, said connection member having a first end positioned on a side of said structural body and a second end positioned on a side of said liner, said second end being disposed on an outer surface of an end part of said liner positioned on said side of structural body;

first fixing means of fixing said first end of said connection member to said structural body; and second fixing means of fixing said second end of said connection member to said end part of said liner.

11. An annular combustor according to claim 10, wherein said connection member is a flat member.

12. An annular combustor according to claim 10, wherein a spacer is disposed between said second end of said connection member and said outer surface of said end part of said liner.

13. An annular combustor according to claim 10, wherein a seal ring is slidably mounted on a part of said structural body corresponding to a position between said first end and said second end, an end edge of said liner on said side of said structural body being in contact with said seal ring.

14. An annular combustor according to claim 13, wherein said seal ring is disposed at a stepped part formed on said part of said structural body corresponding to said position between said first end and said second end.

15. An annular combustor according to claim 13, wherein said seal ring has a surface perpendicular to a central axis of said annular combustor, said end edge of said liner being in contact with said surface perpendicular to said central axis.

16. An annular combustor according to claim 13, wherein said seal ring is pressed against said end edge of said liner by an elastic member.

17. An annular combustor according to claim 10, wherein said structural body is a dome of said annular combustor.

18. An annular combustor according to claim 10, wherein said liner is made of ceramics material.

* * * * *